US012594451B2

(12) United States Patent
Lakshmipathy

(10) Patent No.: US 12,594,451 B2
(45) Date of Patent: Apr. 7, 2026

(54) EXERCISE SYSTEM AND CLIMBING SIMULATOR

(71) Applicant: Narendranath Lakshmipathy, Perrysburg, OH (US)

(72) Inventor: Narendranath Lakshmipathy, Perrysburg, OH (US)

( * ) Notice: Subject to any disclaimer, the term of this patent is extended or adjusted under 35 U.S.C. 154(b) by 169 days.

(21) Appl. No.: 18/682,637

(22) PCT Filed: Aug. 16, 2022

(86) PCT No.: PCT/US2022/040405
§ 371 (c)(1),
(2) Date: Feb. 9, 2024

(87) PCT Pub. No.: WO2023/023013
PCT Pub. Date: Feb. 23, 2023

(65) Prior Publication Data

US 2024/0335693 A1 Oct. 10, 2024

Related U.S. Application Data

(60) Provisional application No. 63/234,298, filed on Aug. 18, 2021.

(51) Int. Cl.
*A63B 21/005* (2006.01)
*A63B 21/00* (2006.01)
*A63B 22/00* (2006.01)

(52) U.S. Cl.
CPC ..... *A63B 21/0058* (2013.01); *A63B 21/4007* (2015.10); *A63B 21/4049* (2015.10); *A63B 22/001* (2013.01); *A63B 2225/09* (2013.01)

(58) Field of Classification Search
CPC ..... A63B 21/0058; A63B 21/4007; A63B 21/4049; A63B 22/001; A63B 2225/09;
(Continued)

(56) References Cited

U.S. PATENT DOCUMENTS 2,079,594 A * 5/1937 Clem ..... A61H 1/0259 482/37
2,403,593 A * 7/1946 Robert ..... A63B 69/04 472/16

(Continued)

*Primary Examiner* — Andrew M Kobylarz
(74) *Attorney, Agent, or Firm* — Kohrman Jackson & Krantz LLP

(57) ABSTRACT

The present invention is directed toward an exercise machine and climbing simulator that enables its users to initiate the climbing or crawling motion whilst being rotated at different angles. This invention includes a rotatable framework and a plurality of foot spines and arm spines that are configured to support the feet and arms of a user. As the framework rotates, the user incurs exercise in maintaining contact with the plurality of foot and hand spines. Each of the foot and hand spines is decoupled from each other, that is, each of the foot and hand spines is configured with independent rotational and lateral movement. By changing the angles of rotation and the positions of the foot and hand spines, gravity is applied in different ways and therefore different muscle groups are targeted. Thus, this invention assists users in acquiring varying degrees of physical fitness and mountain climbing preparation.

18 Claims, 13 Drawing Sheets

(58) Field of Classification Search
CPC ..... A63B 21/4031; A63B 22/0023; A63B 22/205; A63B 69/0048
See application file for complete search history.

(56) References Cited

U.S. PATENT DOCUMENTS

| | | | | |
|---|---|---|---|---|
| 5,403,254 | A | 4/1995 | Lundin et al. | |
| 5,449,334 | A * | 9/1995 | Kingsbury | A63B 22/0605 601/36 |
| 5,679,100 | A | 10/1997 | Charnitski | |
| 5,785,631 | A * | 7/1998 | Heidecke | A63B 22/0005 482/901 |
| 6,464,296 | B2 * | 10/2002 | Sumner | A61H 1/0292 297/326 |
| 6,547,702 | B1 * | 4/2003 | Heidecke | A63B 22/0005 482/57 |
| 8,047,968 | B2 | 11/2011 | Stewart et al. | |
| 10,232,243 | B2 | 3/2019 | Bowers | |
| 11,484,460 | B2 * | 11/2022 | Park | A61H 1/0281 |
| 2003/0001265 | A1 | 1/2003 | Lo | |
| 2010/0016126 | A1 * | 1/2010 | Wu | A63B 69/0048 482/37 |
| 2020/0376332 | A1 * | 12/2020 | Silver | A63B 22/001 |

* cited by examiner

EXERCISE SYSTEM AND CLIMBING SIMULATOR

BACKGROUND OF INVENTION

Mountaineering, also called Mountain climbing, is a popular sport with over 25 million people climbing regularly around the world. In many instances, the mountain being climbed has a height that requires the climber to be physically fit. The term "mountain fitness" has been defined as the ability to move efficiently and safely over mountainous terrain and uneven, rocky surfaces, and endure continuous uphill movement for the hours it will take to get to the top of the mountain. The term "mountain fitness" further includes the strength and stamina required to safely descent from the top of the mountain.

Various methods are known to acquire mountain fitness, including the non-limiting examples of personal trainers, rock wall trainers, running up and down stairs and the like. However, these conventional methods can be time-consuming, expensive and may not result with the desired results.

It would be advantageous if the action or movement of climbing or crawling up or down a mountain could be better simulated.

SUMMARY OF INVENTION

The present invention is directed toward an exercise machine and climbing simulator that enables its users to initiate the climbing or crawling motion whilst being rotated at different angles. This invention is a direct solution to the lack of mountain climbing simulation products on the market. It includes a rotatable framework and a plurality of foot spines and arm spines that are configured to support the feet and arms of a user. As the framework rotates, the user incurs strenuous physical activity in maintaining contact with the plurality of foot and hand spines. Each of the foot and hand spines is decoupled from each other, that is, each of the foot and hand spines is configured with independent rotational and lateral movement. By changing the angles of rotation and the positions of the foot and hand spines, gravity is applied in different ways and therefore different muscle groups of the user are targeted. Thus, this invention assists users in acquiring varying degrees of physical fitness and mountain climbing preparation.

DETAILED DESCRIPTION

The exercise machine and climbing simulator will now be described with occasional reference to specific embodiments. The exercise machine and climbing simulator may, however, be embodied in different forms and should not be construed as limited to the embodiments set forth herein. Rather, these embodiments are provided so that this disclosure will be thorough and complete, and will fully convey the scope of the exercise machine and climbing simulator to those skilled in the art.

Unless otherwise defined, all technical and scientific terms used herein have the same meaning as commonly understood by one of ordinary skill in the art to which the exercise machine and climbing simulator belongs. The terminology used in the description of the exercise machine and climbing simulator herein is for describing particular embodiments only and is not intended to be limiting of the exercise machine and climbing simulator. As used in the description of the exercise machine and climbing simulator and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the exercise machine and climbing simulator. Notwithstanding that the numerical ranges and parameters setting forth the broad scope of the exercise machine and climbing simulator are approximations, the numerical values set forth in the specific examples are reported as precisely as possible. Any numerical values, however, inherently contain certain errors necessarily resulting from error found in their respective measurements.

The description and figures disclose an exercise machine and climbing simulator. The exercise machine and climbing simulator is configured to simulate the action or movement of crawling up a mountain and down a mountain and is further configured to instill a level of mountain fitness to a user.

Figure 1:
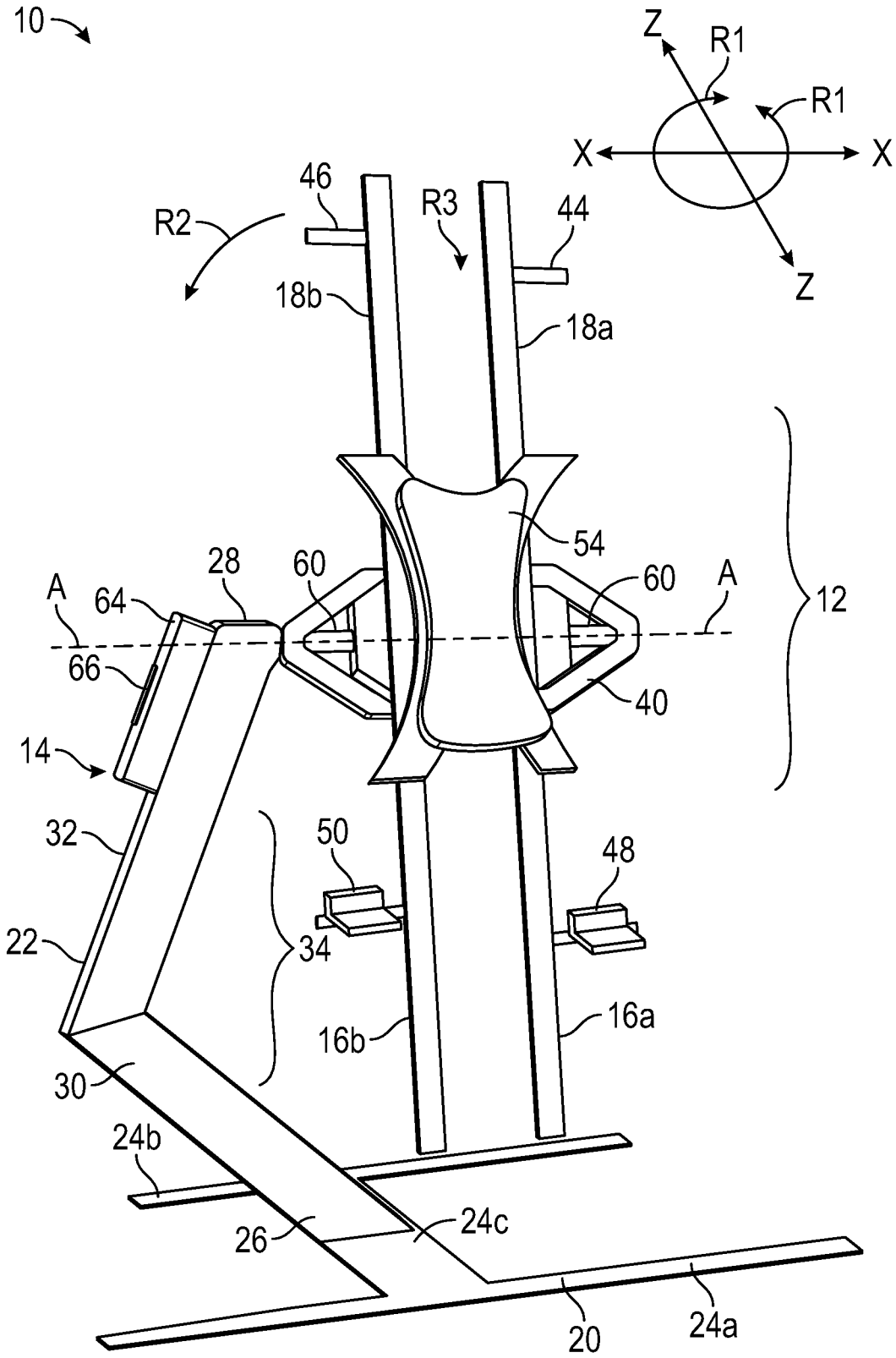
FIG. 1 is a perspective view of an exercise machine and climbing simulator in a first orientation in accordance with the invention.

Referring now to the drawings, there is illustrated in FIG. 1 an exercise machine and climbing simulator (hereafter "simulator") generally at 10. The simulator 10 is configured to simulate the action or movement of crawling up or down a mountain and is further configured to instill a level of mountain fitness to a user. Generally, simulator 10 includes a rotatable framework 12 supported by a base assembly 14. The rotatable framework 12 is shown in a first rotational orientation. The rotatable framework 12 includes a plurality of foot spines 16*a*, 16*b* configured to support the feet of a user during rotation of the framework 12 and a plurality of hand spines 18*a*, 18*b* configured to support the hands of a user during rotation of the framework 12. As the framework 12 rotates, the user incurs exercise in maintaining contact with the plurality of foot and hand spines 16*a*, 16*d*, 18*a*, 18*b*. As will be explained in more detail below, each of the foot and hand spines 16*a*, 16*b*, 18*a*, 18*d* is decoupled from each other, that is, each of the foot and hand spines 16*a*, 16*b*, 18*a*, 18*d* is configured with independent rotational and lateral movement.

Referring again to FIG. 1, the base assembly 14 includes a floor assembly 20 and a column assembly 22 extending in a generally upward direction from the floor assembly 20. The floor assembly 20 is configured to provide a stable base for the simulator 10 and includes a plurality of support members 24*a*-24*c*. In the illustrated embodiment, the support members 24*a*, 24*b* have a parallel arrangement and the support member 24*c* is positioned in a perpendicular orientation between the support members 24*a*, 24*b* and is configured as a connector for the support members 24*a*, 24*b*. However, in alternate embodiments, the floor assembly 20 can have other structures, systems, mechanisms, and devices configured to provide a stable base for the simulator 10.

Referring again to FIG. 1, the column assembly 22 has a first end 26 that is connected to the floor assembly 20 and an opposing second end 28. The column assembly 22 is configured to support the framework 12 in a vertically upward position as the framework 12 rotates about an axis A-A extending in a generally horizontal orientation at the second end 28 of the column assembly 22.

Referring again to FIG. 1, the column assembly 22 has a first leg 30 and a second leg 32. The legs 30, 32 have an angled orientation and cooperate to form a recess 34 between the first and second ends 26, 28. The recess 34 is configured to provide clearance for the arms and legs of a user as the framework 12 rotates about an axis A-A. It should be appreciated that the column assembly 22 can have any structures, systems, mechanisms, and orientation sufficient for the functions described herein.

Referring again to FIG. 1, the hand spine 18*a* includes a hand handle 44 configured for axial travel along the length of the hand spine 18*a*. In a similar manner, the hand spine 18*b* includes a hand handle 46 that is configured for axial travel along the length of the hand spine 18*b*. The axial travel of the hand handle 44 along the length of the hand spine 18*a* is independent of the axial travel of the hand handle 46 along the length of the hand spine 18*b*.

Referring again to FIG. 1, the foot spine 16*a* includes a footrest 48 configured for axial travel along the length of the foot spine 16*a*. In a similar manner, the foot spine 16*b* includes a footrest 50 that is configured for axial travel along the length of the foot spine 16*b*. The axial travel of the footrest 48 along the length of the foot spine 16*a* is independent of the axial travel of the root rest 50 along the length of the foot spine 16*b*. It should also be appreciated that the axial travels of the hand handles 44, 46 are independent of the axial travels of the footrests 48, 50.

Referring again to FIG. 1, each of the foot and hand spines 16*a*, 16*b*, 18*a*, 18*b* is formed from a structural member, such as the non-limiting example of steel tube. However, in other embodiments, each of the foot and hand spines 16*a*, 16*b*, 18*a*, 18*b* can be formed from other desired materials or combinations of materials, sufficient for the functions described herein.

Referring again to FIG. 1, as each of the hand spines 16*a*, 16*b* move in the x, z and rotational directions, each of the hand handles 44, 46 moves accordingly. In this manner, the changing positions of the hand handles 44, 46 enable the hands of the user to be alternately either closer to each other or further apart from each other, thereby advantageously enhancing the simulated action or movement of crawling up or down a mountain and instilling a level of mountain fitness to a user.

Referring again to FIG. 1, as each of the foot spines 16*a*, 16*b* move in the x, z and rotational directions, each of the footrests 48, 50 moves accordingly. In this manner, the changing positions of the footrests 48, 50 enable the feet of the user to be alternately either closer to each other or further apart from each other, thereby advantageously enhancing the simulated action or movement of crawling up or down a mountain and instilling a level of mountain fitness to a user.

Referring again to FIG. 1, each of the foot spines 16*a*, 16*b* and each of the hand spines 18*a*, 18*b* are pivotally mounted to a hub section 40. In the illustrated embodiment, the hub section 40 includes one or more axles 60 configured to receive each of the foot spines 16*a*, 16*b* and each of the hand spines 18*a*, 18*b* in a manner to facilitate pivotal movement. However, in alternate embodiments, each of the foot spines 16*a*, 16*b* and each of the hand spines 18*a*, 18*b* can be supported by the framework with other structures, mechanisms, and devices sufficient to facilitate pivotal movement.

Referring again to FIG. 1, the hub section 40 includes a padded chest protector 54. The padded chest protector 54 is configured for contact with the chest of the user. The padded chest protector 54 is further configured to injury to the user during use of the simulator 10.

Referring again to FIG. 1, the floor assembly 20 and the column assembly 22 cooperate to form a fulcrum, thereby facilitating rotational movement of the framework 12, as represented by movement arrows R2, R3. Rotation of the framework 12 about the axis A-A is actuated by a motor 64. In the illustrated embodiment, the motor 64 has the form of an electric motor. The electric motor can have any desired form, such as the non-limiting example of a servo motor configured for precise rotational movement of the framework 12 and can have any desired source of electrical power, including the non-limiting example of battery power. However, in other embodiments, other devices can be used sufficient to facilitate rotational movement of the framework 12.

Referring again to FIG. 1, a controller 66 is used to control the motor 64. The controller 66 can have any form and configuration sufficient to control the motor 64. It is further contemplated the controller 66 can be programmed with pre-defined rotational movements, such as to define a workout routine. The pre-defined workout routines can vary the rotational movement of the framework 12 and the foot and hand spines 16*a*, 16*b*, 18*a*, 18*b*, thereby varying the intensity/resistance in regard to the simulated motion of crawling up or down a mountain. It should be appreciated that the simulator 10 can incorporate other structures, mechanisms, and devices to adjust the intensity/resistance in regard to the simulated motion of crawling up or down a mountain. Non-limiting examples of other mechanisms include pneumatic devices, geared mechanisms, banded mechanisms, and the like.

Referring again to FIG. 1 and as described above, the framework 12 rotates about the one or more axles 60 extending from the second end 28 of the column assembly 22. As the same time, each of the foot and hand spines 16*a*, 16*b*, 18*a*, 18*b* are configured for independent movement in the x, z, and RI directions. In addition, and also simultaneously, each of the hand handles 44, 46 and footrests are independently configured for axial movement along the lengths of their respective foot and hand spines 16*a*, 16*b*, 18*a*, 18*b*. Advantageously, the movement features combine to vary the intensity/resistance with regard to the simulated motion of crawling up or down a mountain.

Figure 2:
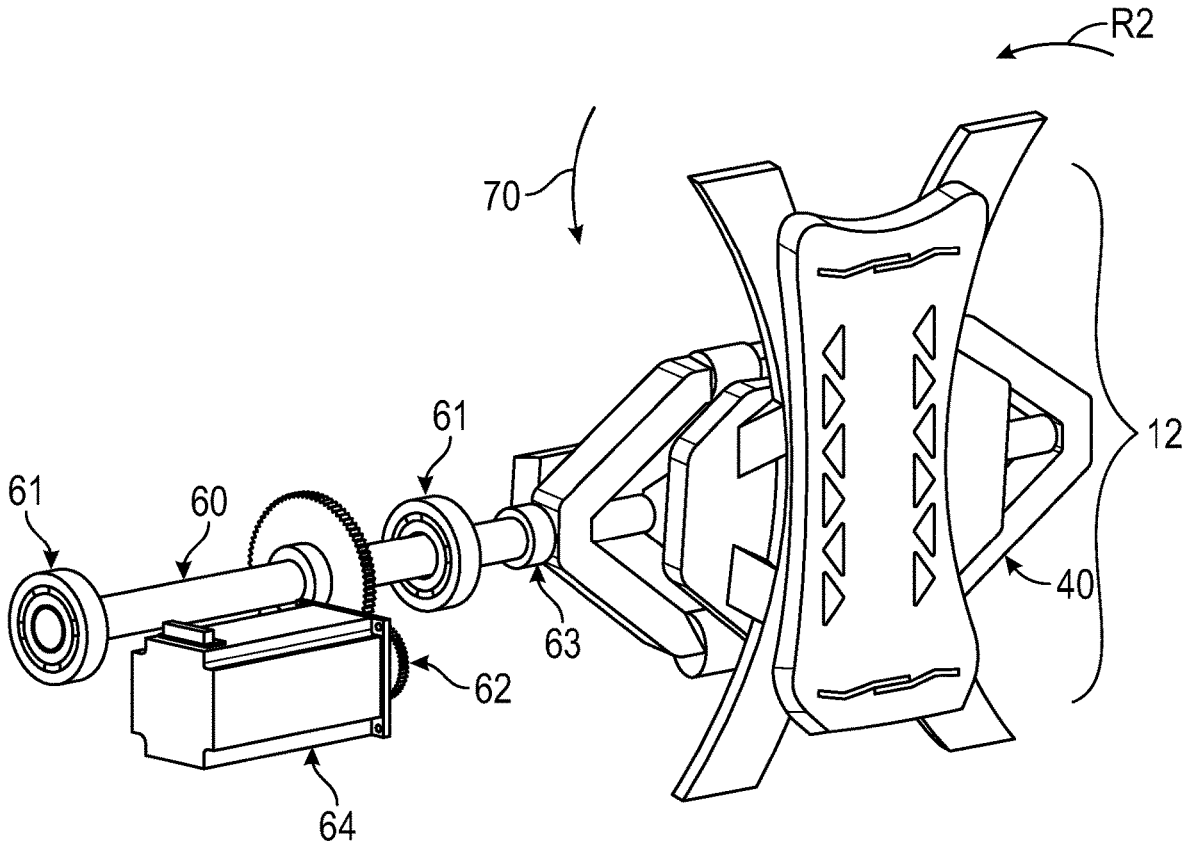
FIG. 2 is an exploded view of a motor drivetrain component of the exercise machine and climbing simulator of FIG. 1.

Referring now to FIG. 2, an exploded view of one embodiment of a motor drivetrain 70 is shown. The hub section 40 is connected to the axle 60, the motor 64, ball bearings 61, geared transmission 62, and shaft coupler 63. These components, using the mechanical power provided by the motor, enable the axle 60 to rotate the hub 40 in a 360-degree motion, R2. In other embodiments, various components can be incorporated into the motor drivetrain sufficient to facilitate rotational movement of the hub 40.

Figure 3:
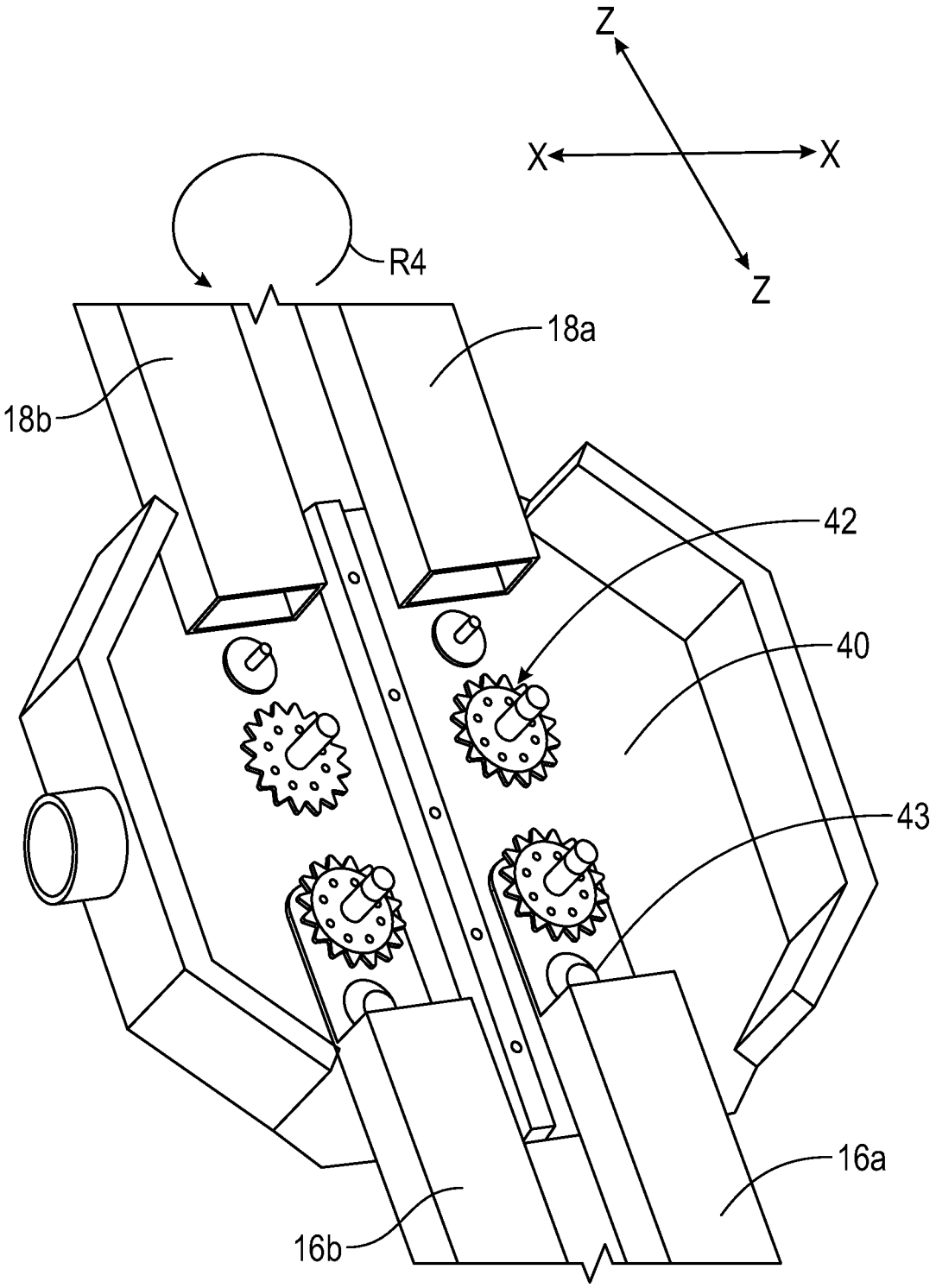
FIG. 3 is a further exploded partial view of a hub component of the exercise machine and climbing simulator of FIG. 1.

Referring now to FIG. 3, an exploded view of one embodiment of the hub section 40 is shown. Each of the foot spines 16*a*, 16*b* and each of the hand spines 18*a*, 18*b* are independently connected to and supported by separate pivot points positioned within the hub section 40, thereby facilitating independent movement of each of the foot and hand spines 16*a*, 16*b*, 18*a*, 18*b*. The hand spine 18*a* is supported by the hub section 40 for movement in the x and z directions as well as rotational movement as depicted by direction arrow R4. The hub section 40 supports the hand spine 18*b* and the foot spines 16*a*, 16*b* in a manner such as to facilitate similar directional movements. In this manner, the separate movements of the hand and foot spines 16*a*, 16*b*, 18*a*, 18*b* are decoupled from each other. In the illustrated embodiment, the pivot points of 18*a* and 18*b* are shown in the form of electric magnetic connection, whereas the pivot points of 16*a* and 16*b* are shown as hinges 43. Gears 42 are shown as a part of a Gear and Pulley system (pulleys not shown for clarity), to depict the internal components that drive the movement. It should be noted, however, that these internal pivot points can have any desired form, configured to facilitate the decoupled lateral and rotational movements of each of the foot spines and hand spines.

Figure 4:
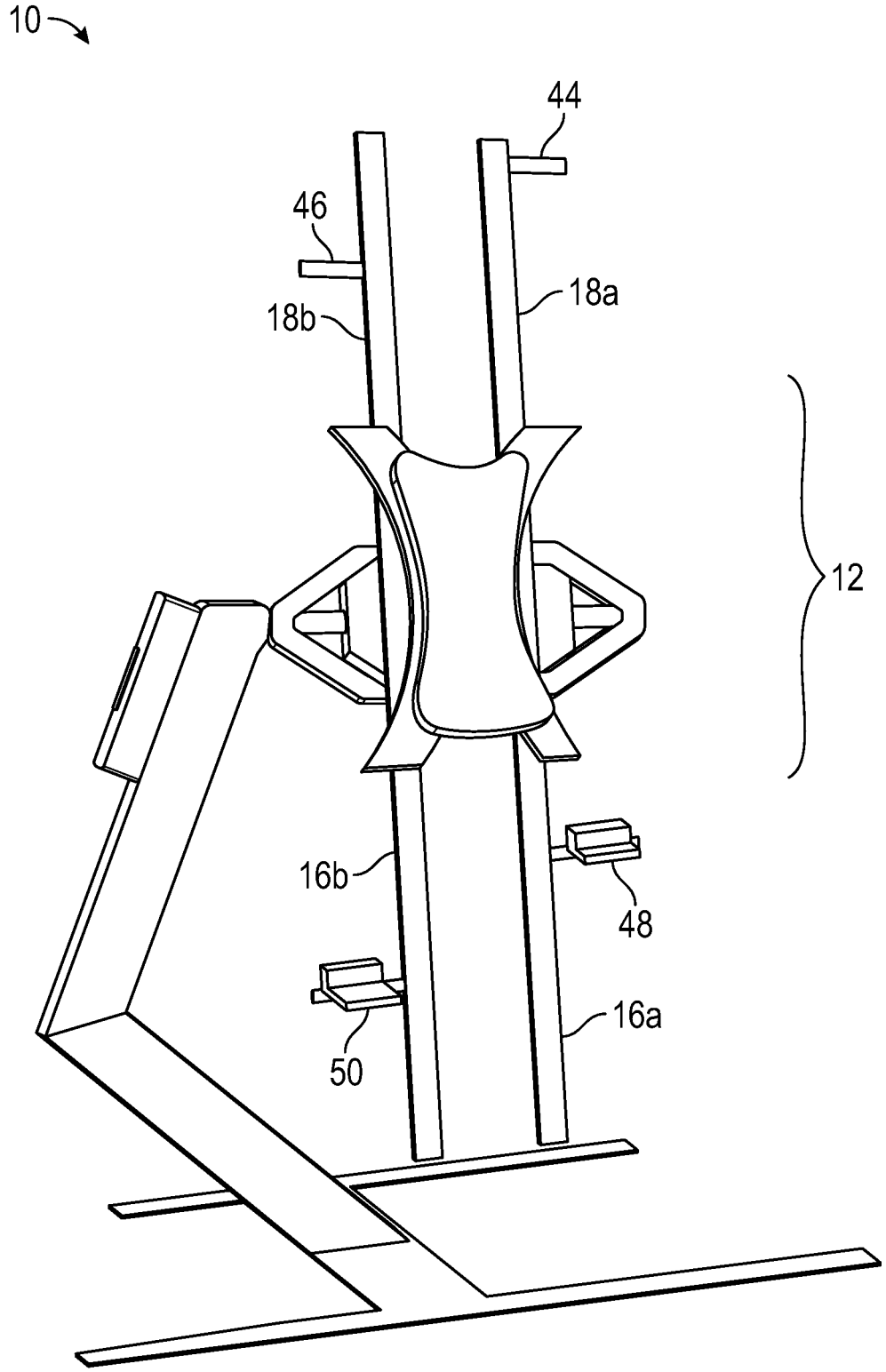
FIG. 4 is a perspective view of the exercise machine and climbing simulator of FIG. 1 illustrating a second orientation.

Referring now to FIGS. 4-13, various combinations of the movement features are illustrated. Referring now to FIG. 4, movement of various portions of the framework 12 is illustrated. The framework 12 remains in a generally vertical orientation with the foot spines 16*a*, 16*b* extending in a generally downward vertical direction and the hand spines 18*a*, 18*b* extending in a generally upward direction. In this illustration, the foot spines 16*a*, 16*b* remain parallel to each other and the hand spines 18*a*, 18*b* remain parallel to each other. Further to this illustration, the hand handle 44 has moved in an axial direction to a distal end of the hand spine 18*a*, the hand handle 46 has moved in an axial direction to a proximate midpoint of the hand spine 18*b*, the footrest 48 has moved in an axial direction toward the hub section 40 and the footrest 50 has moved in an axial direction toward the distal end of the foot spine 16*b*. Still further to this illustration, each of the foot spines 16*a*, 16*b* and each of the hand spines 18*a*, 18*b* have no directional nor rotational movements.

Figure 5:
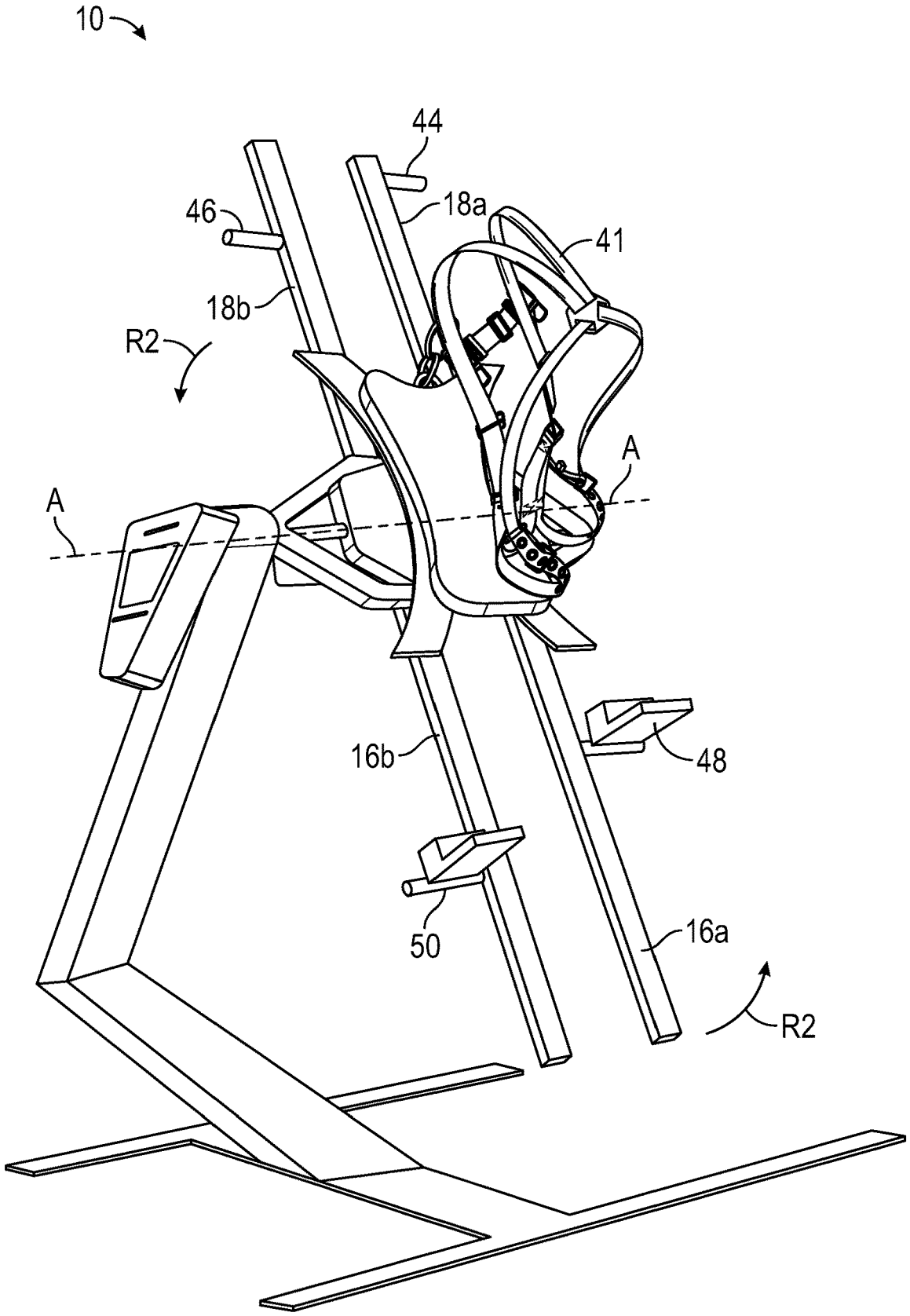
FIG. 5 is a perspective view of the exercise machine and climbing simulator of FIG. 1 illustrating a third orientation

Referring now to FIG. 5, counterclockwise rotational movement of the framework 12 (as represented by direction arrows R2) about axis A-A is illustrated with the foot spines 16*a*, 16*b*, hand spines 18*a*, 18*b*, hand handles 44, 46 and footrests 48, 50 remaining the same positions as shown in FIG. 4 and described above.

Figure 6:
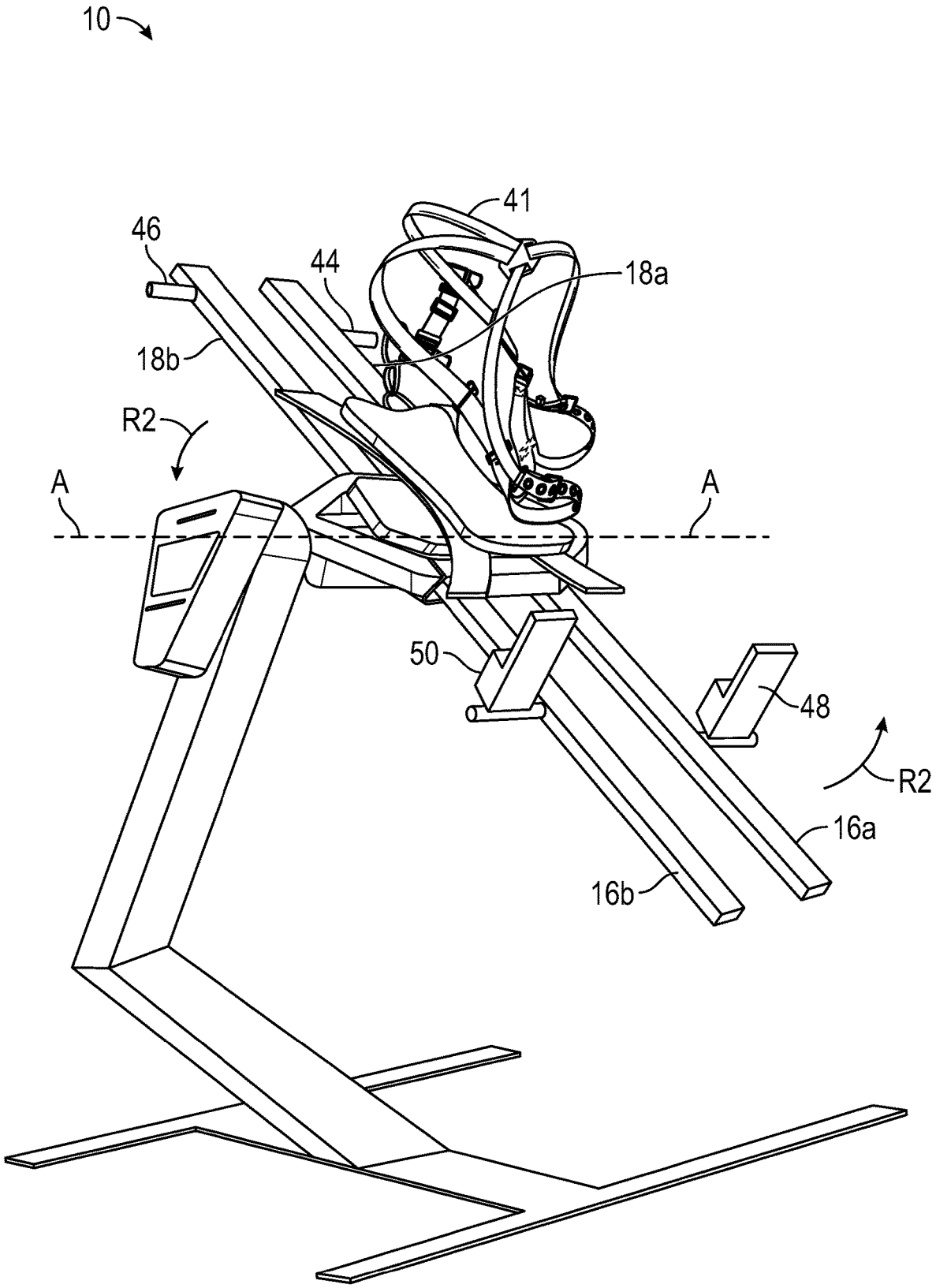
FIG. 6 is a perspective view of the exercise machine and climbing simulator of FIG. 1 illustrating a fourth orientation.

Referring now to FIG. 6, further counterclockwise rotational movement of the framework 12 (as represented by direction arrows R2) about axis A-A is illustrated with the foot spines 16*a*, 16*b* remaining parallel to each other and the hand spines 18*a*, 18*b* remaining parallel to each other. Further to this illustration, the hand handle 44 has moved in an axial direction toward the hub section 40, the hand handle 46 has moved in an axial direction to the distal end of the hand spine 18*b*, the footrest 48 has moved in an axial direction toward the distal end of the foot spine 16*a* and the footrest 50 has moved in an axial direction toward the hub section. Still further to this illustration, each of the foot spines 16*a*, 16*b* and each of the hand spines 18*a*, 18*b* have no directional nor rotational movements.

Further shown in this Figure is the addition of a user attachment device 41, which may be in the form of a harness. A harness may be incorporated onto the hub section 40 to enable a user to securely attach his or her body to the framework while it is being rotated along axis A-A. It should be appreciated that other structures, mechanisms, and devices to securely connect a user to the framework may be used. Non-limiting examples of other attachment devices include straps, garments, Velcro, and the like.

Figure 7:
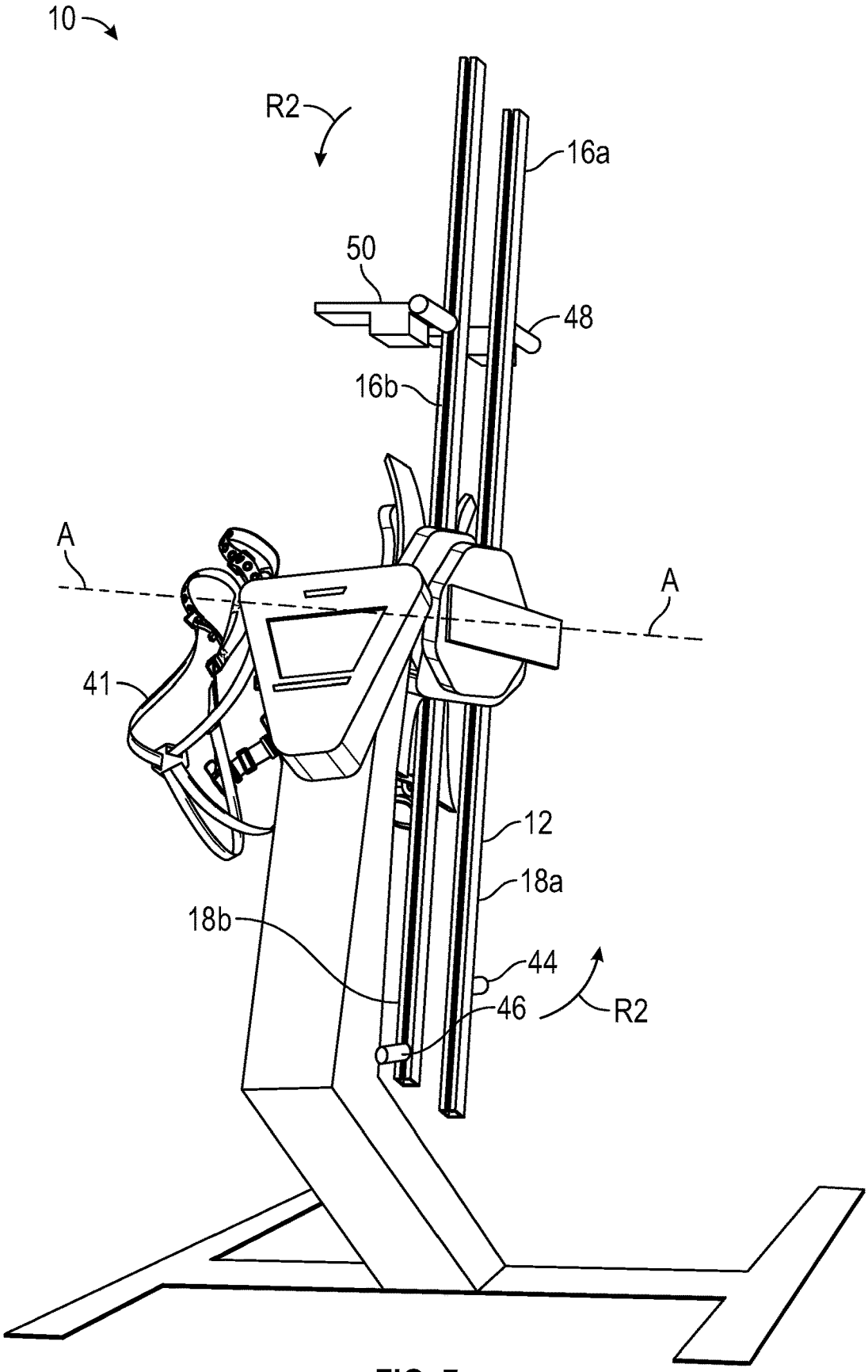
FIG. 7 is a perspective view of the exercise machine and climbing simulator of FIG. 1 illustrating a fifth orientation.

Referring now to FIG. 7, further counterclockwise rotational movement of the framework 12 (as represented by direction arrows R2) about axis A-A is illustrated with the foot spines 16*a*, 16*b* remaining parallel to each other and the hand spines 18*a*, 18*b* remaining parallel to each other. In this position, the framework 12 is nearly inverted from that shown in FIG. 1. Further to this illustration, the hand handles 44, 46 and the footrest 48 remain in the same position as shown in FIG. 4. The footrest 50 has moved in an axial direction toward the distal end of the foot spine 16*b*. Still further to this illustration, each of the foot spines 16*a*, 16*b* and each of the hand spines 18*a*, 18*b* have no directional nor rotational movements.

Figure 8:
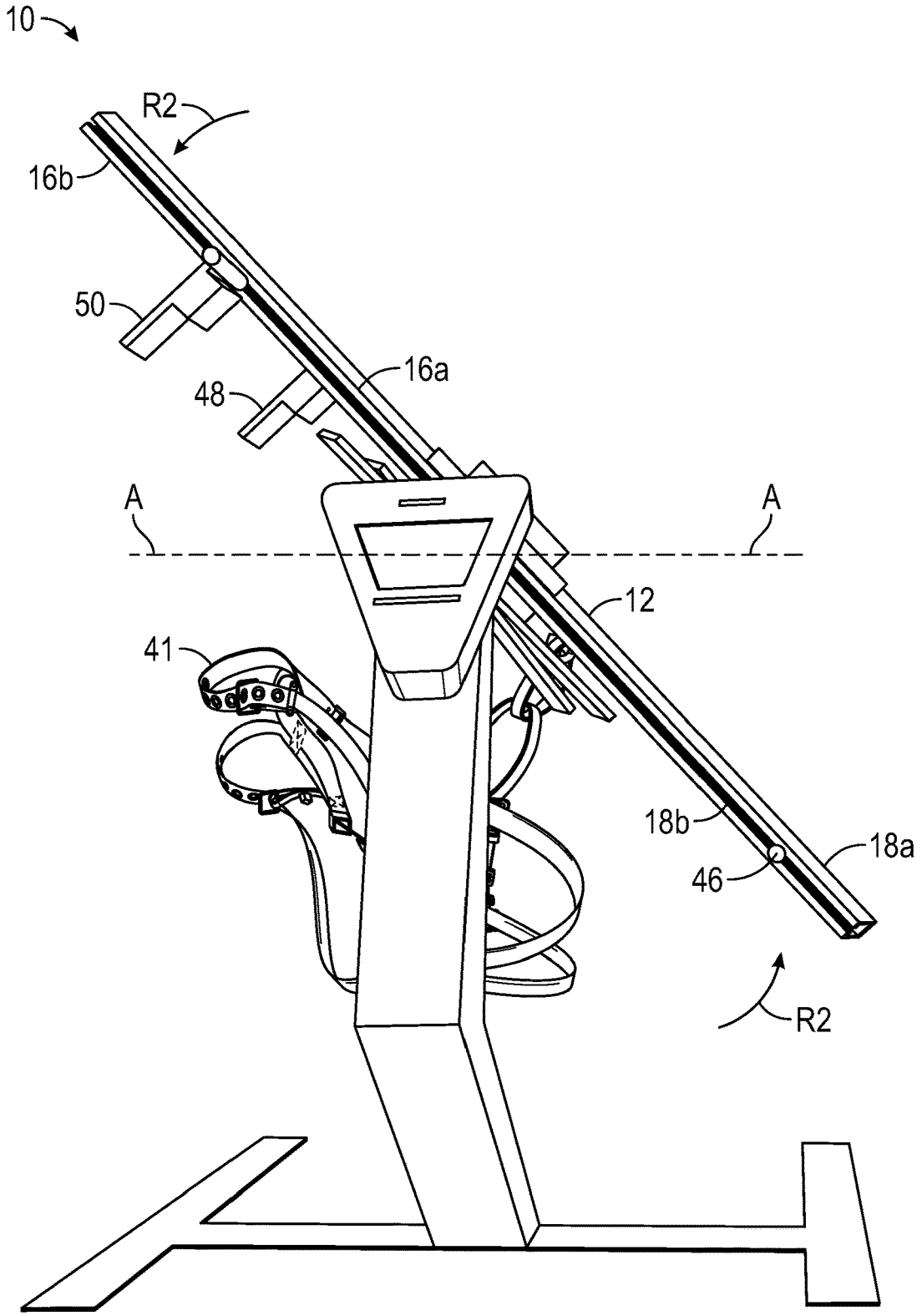
FIG. 8 is a perspective view of the exercise machine and climbing simulator of FIG. 1 illustrating a sixth orientation.

Referring now to FIG. 8, continued counterclockwise rotational movement of the framework 12 (as represented by direction arrows R2) about axis A-A is illustrated with the foot spines 16*a*, 16*b*, hand spines 18*a*, 18*b*, hand handles 44, 46 and footrests 48, 50 remaining the same positions as shown in FIG. 5 and described above. Still further to this illustration, each of the foot spines 16*a*, 16*b* and each of the hand spines 18*a*, 18*b* have no directional nor rotational movements.

Figure 9:
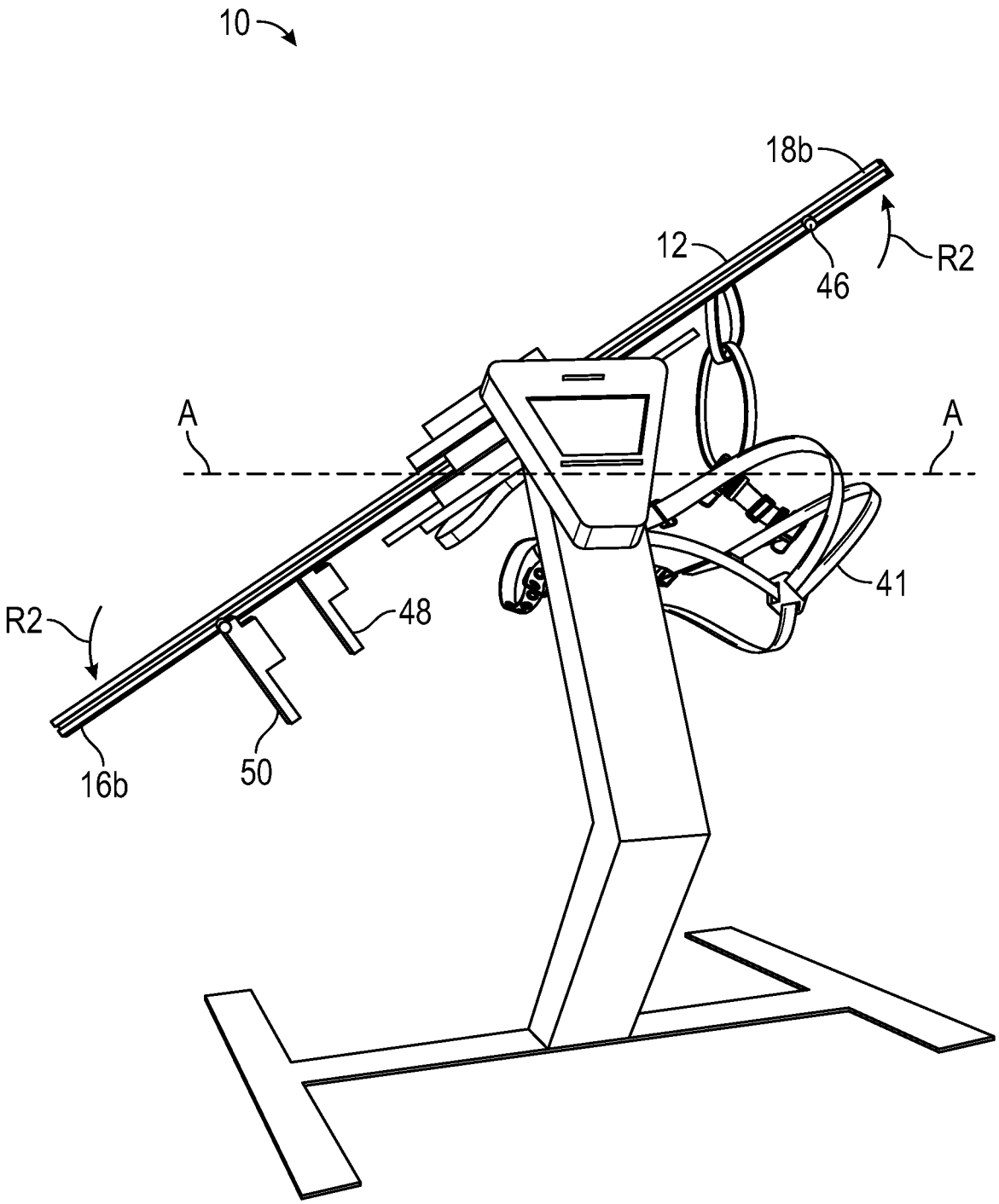
FIG. 9 is a perspective view of the exercise machine and climbing simulator of FIG. 1 illustrating a seventh orientation.

Referring now to FIG. 9, continued counterclockwise rotational movement of the framework 12 (as represented by direction arrows R2) about axis A-A is illustrated with the foot spines 16*a*, 16*b*, hand spines 18*a*, 18*b*, hand handles 44, 46 and footrests 48, 50 remaining the same positions as shown in FIG. 5 and described above. Still further to this illustration, each of the foot spines 16*a*, 16*b* and each of the hand spines 18*a*, 18*b* have no directional nor rotational movements.

Figure 10:
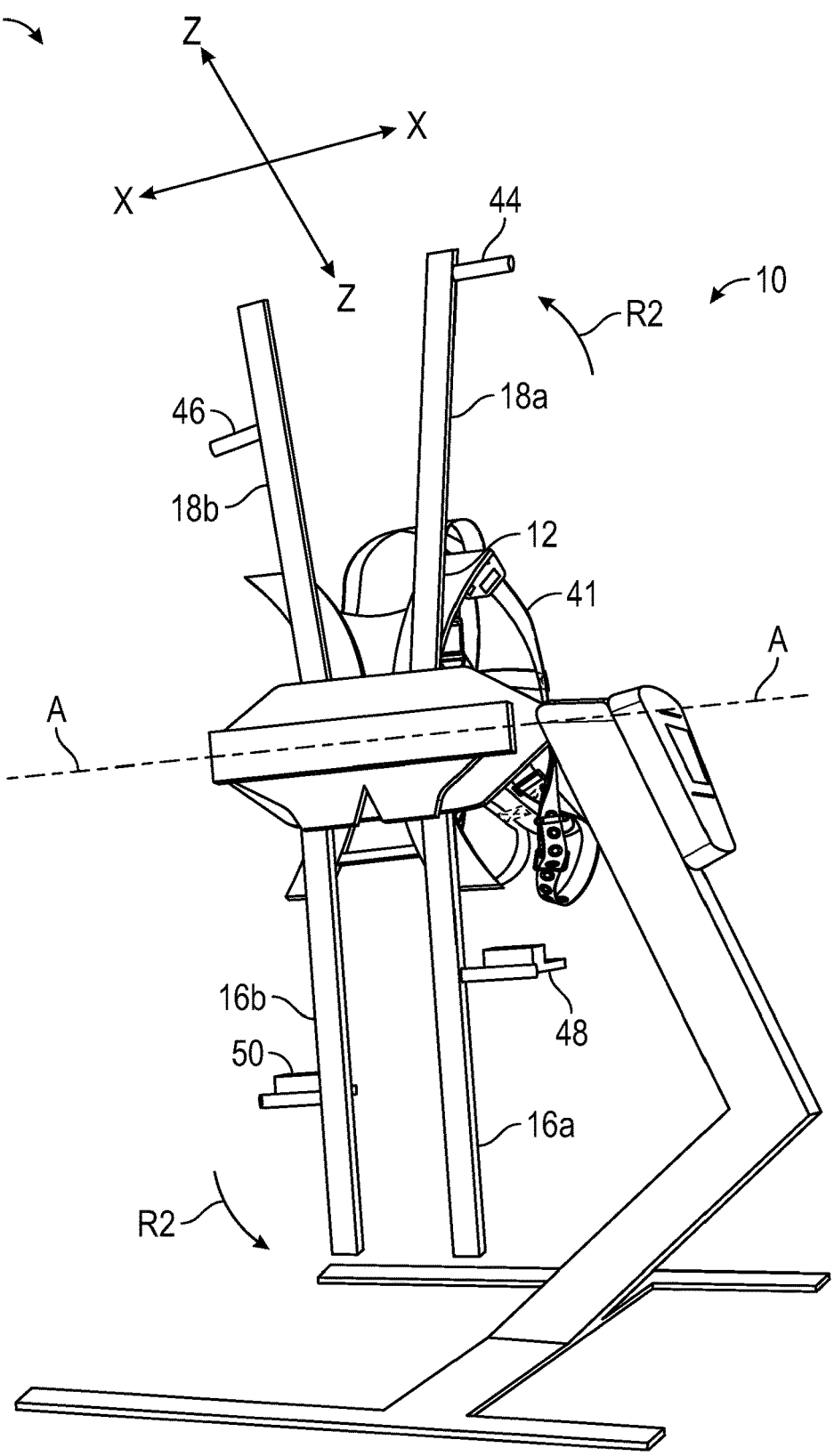
FIG. 10 is a perspective view of the exercise machine and climbing simulator of FIG. 1 illustrating an eighth orientation.

Referring now to FIG. 10, further counterclockwise rotational movement of the framework 12 (as represented by direction arrows R2) about axis A-A is illustrated. With this rotation, the framework 12 has completed a full rotation and is nearly in the same orientation as that shown in FIG. 1 with the foot spines 16*a*, 16*b* remaining parallel to each other. The distal ends of the hand spines 18*a*, 18*b* have been moved in opposing x directions such that the distal ends are further apart than that shown in FIG. 5. Further to this illustration, the hand handle 44 has moved in an axial direction toward the distal end of the hand spine 18*a*, the hand handle 46 has moved in an axial direction to a proximate midpoint of the hand spine 18*b*, the footrest 48 has moved in an axial direction toward the hub section 40 and the footrest 50 has moved in an axial direction toward the distal end of the foot spine 16*b*. Still further to this illustration, each of the foot spines 16*a*, 16*b* and each of the hand spines 18*a*, 18*b* have no rotational movements.

Figure 11:
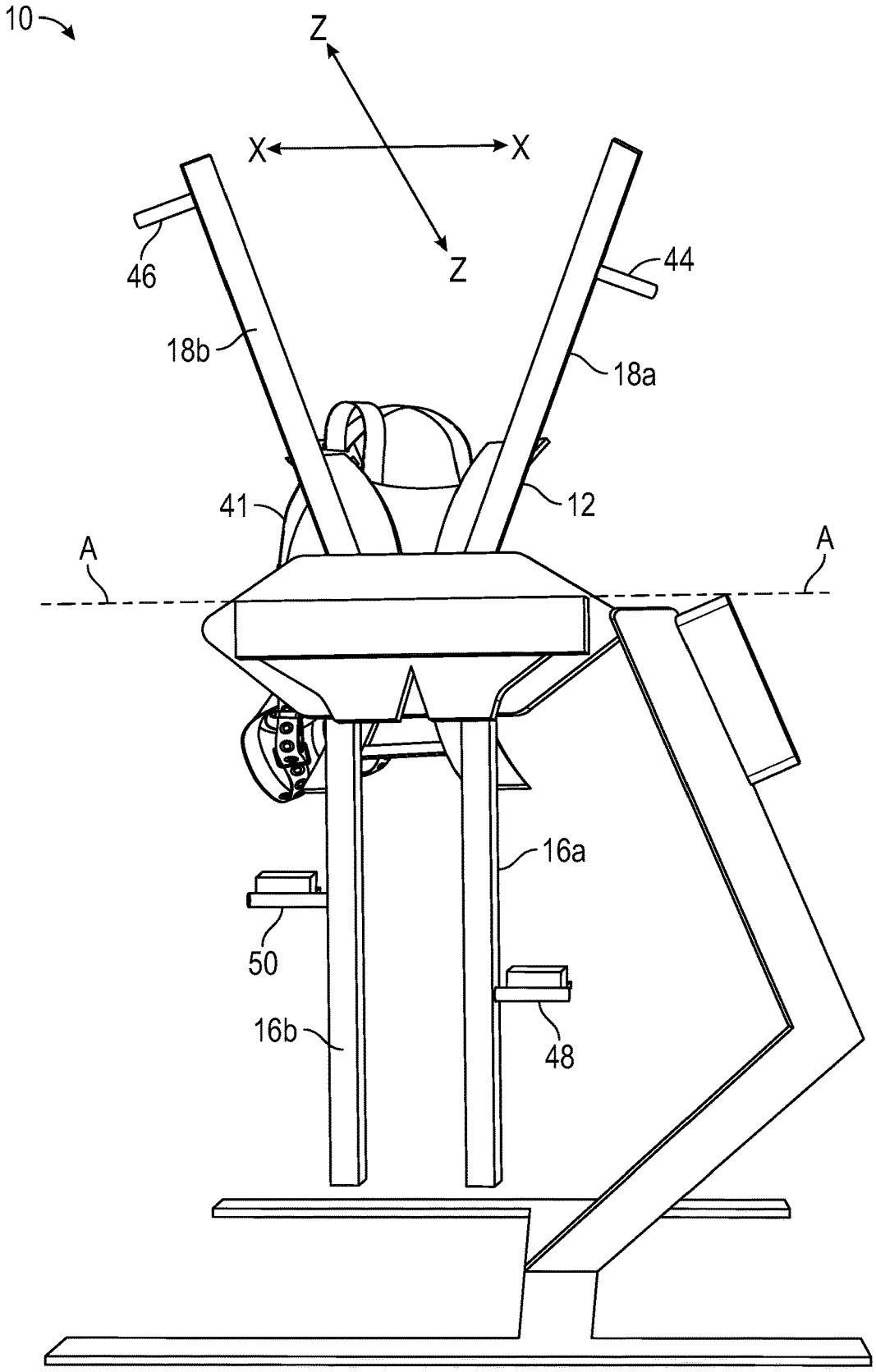
FIG. 11 is a perspective view of the exercise machine and climbing simulator of FIG. 1 illustrating a ninth orientation.

Referring now to FIG. 11, the framework 12 remains in the same rotational orientation as shown in FIG. 10. In this position, the foot spines 16*a*, 16*b* remain parallel to each other, however the footrest 48 has moved in an axial direction toward the distal end of the foot spine 16*a* and the footrest 50 has moved in an axial direction toward the hub section 40. The distal ends of the hand spines 18*a*, 18*b* continue movement in opposing x directions such that the distal ends are further apart than that shown in FIG. 9. Further to this illustration, the hand handle 44 has moved in an axial direction toward the hub section 40 and the hand handle 46 has moved in an axial direction toward the distal end of the hand spine 18*b*. Still further to this illustration, each of the foot spines 16*a*, 16*b* and each of the hand spines 18*a*, 18*b* have no rotational movements.

Figure 12:
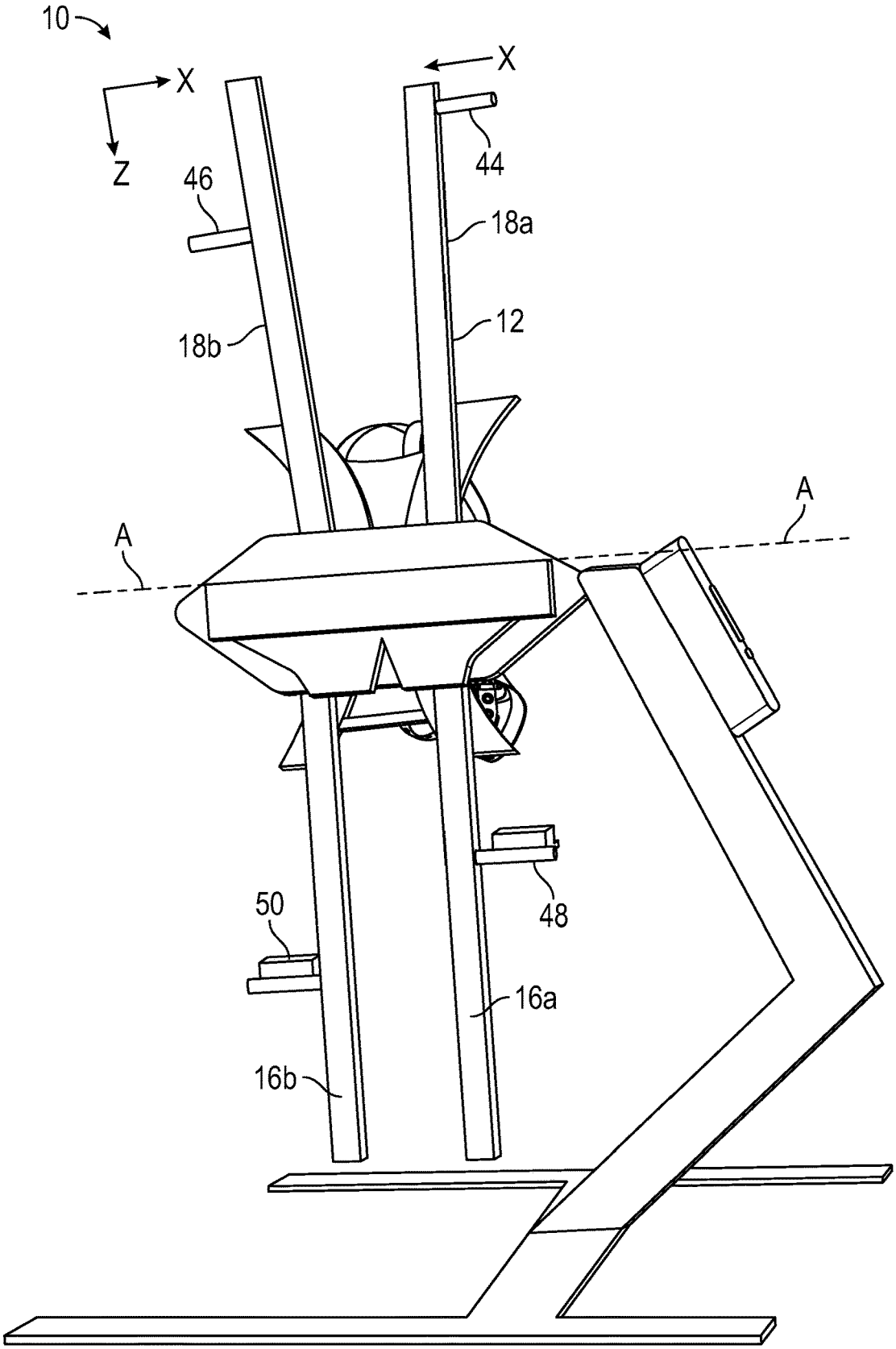
FIG. 12 is a perspective view of the exercise machine and climbing simulator of FIG. 1 illustrating a tenth orientation.

Referring now to FIG. 12, the framework 12 remains in the same rotational orientation as shown in FIG. 10. In this position, the foot spines 16*a*, 16*b* remain parallel to each other, however the footrest 48 has moved in an axial direction toward the hub section 40 and the footrest 50 has moved in an axial direction toward the distal end of the foot spine 16*b*. The distal end of the hand spine 18*a* has been moved in an x direction. The distal end of the hand spine 18*b* has been moved in both an x direction and a z direction such that the distal ends of the hand spines 18*a*, 18*b* are further apart in a z direction than that shown in FIG. 9. Further to this illustration, the hand handle 44 has moved in an axial direction toward the distal end of the hand spine 18*a* and the hand handle 46 has moved in an axial direction toward the hub section 40. Still further to this illustration, each of the foot spines 16*a*, 16*b* and each of the hand spines 18*a*, 18*b* have no rotational movements.

Figure 13:
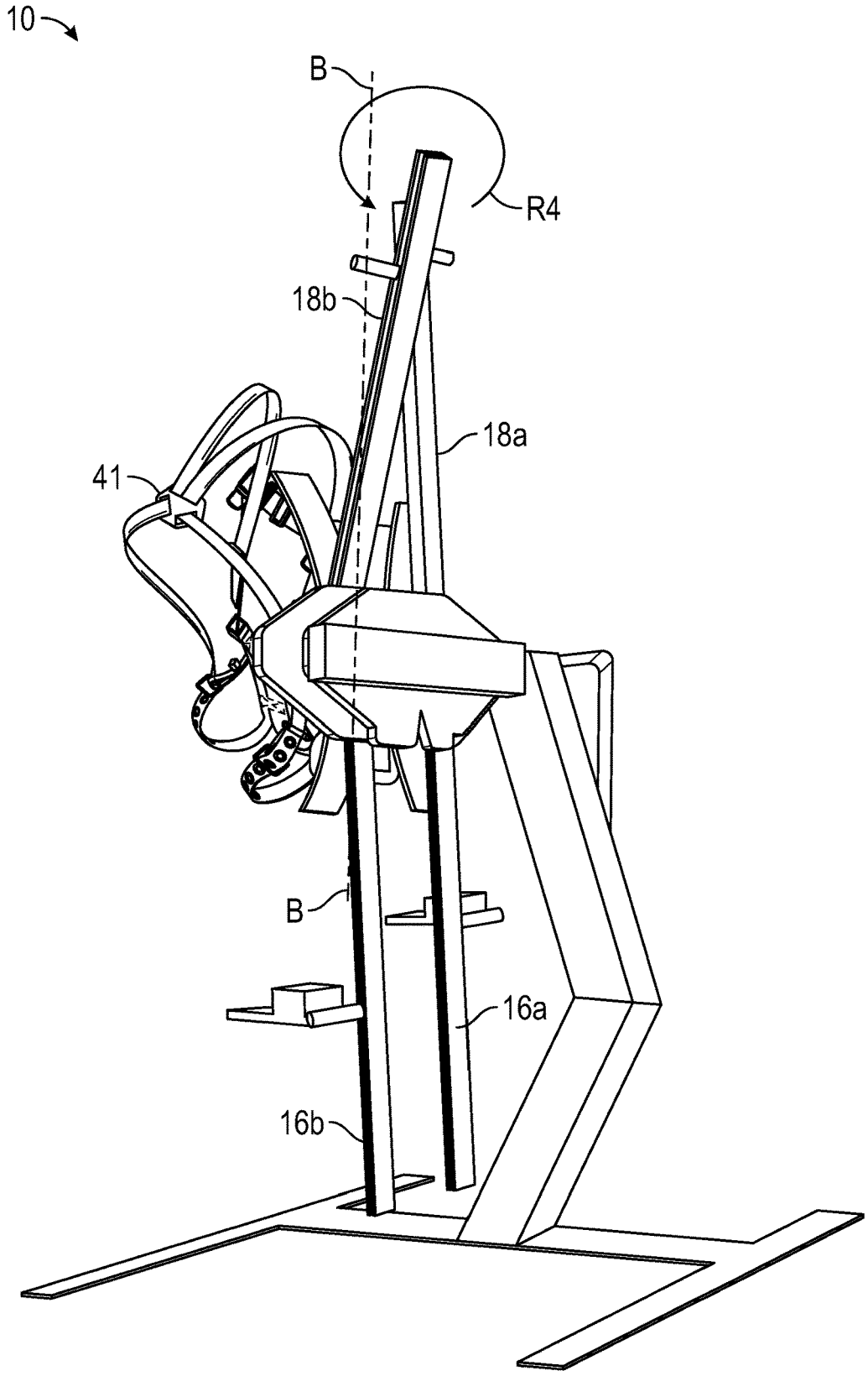
FIG. 13 is a perspective view of the exercise machine and climbing simulator of FIG. 1 illustrating an eleventh orientation.

Referring now to FIG. 13, the framework 12 remains in the same rotational orientation as shown in FIG. 10. In this illustration, the hand spine 18*b* is rotated about a vertical axis B-B, as denoted by rotation arrow R4, while the hand spine 18*a* and the foot spines 16*a*, 16*b* remain in a stationary arrangement. It should be appreciated that in other embodiments, any desired quantity of spines could be rotated while the remaining spines are kept in a stationary arrangement.

The simulator 10 provides many benefits, although all benefits may not be present in all embodiments. First, the simulator 10 is configured to simulate the action or movement of crawling up or down a mountain. Second, the simulator 10 is easily adaptable to users of different heights and/or abilities. Third, the simulator 10 includes a motor configured to precisely control rotation of the framework 12, thereby controlling the intensity/resistance of the workout. Fourth, the simulator 10 can be easily programmed with pre-defined workout routines. Finally, the simulator 10 provides a balance between several desired workout benefits, including strength training, cardio training, balance, agility, and coordination.

While the simulator 10 shown in FIGS. 1-13 and described above includes the framework 12 pivotally mounted to the base assembly 14, foot spines 16*a*, 16*b*, hand spines 18*a*, 18*b* and the padded chest protector 54, it should be appreciated that in other embodiments, the simulator 10 can incorporate other structures, methods, and devices sufficient to simulate the action or movement of crawling up or down a mountain.

As shown in FIGS. 1-13, any desired combination of the movement features of the framework 12, foot spines 16*a*, 16*b*, hand spines 18*a*, 18*b*, hand handles 44, 46 and footrests 48, 50 can be accomplished, thereby advantageously enhancing the simulated action or movement of crawling up or down a mountain and instilling a level of mountain fitness to a user.

In accordance with the provisions of the patent statutes, the principle and mode of operation of the exercise machine and climbing simulator have been explained and illustrated in a certain embodiment. However, it must be understood that the exercise machine and climbing simulator may be practiced otherwise than as specifically explained and illustrated without departing from its spirit or scope.

What is claimed is:

1. An exercise system and climbing simulator comprising:

a base support frame in which one end is configured to contact a floor or ground surface;

an axle that extends from an opposing second end of the base support frame, wherein the axle extends in a horizontal direction parallel to the ground surface;

a rotatable framework that is attached to the axle such that the rotatable framework rotates in a 360-degree motion around the axle;

a motor that actuates rotation of the rotatable framework around the axle;

a controller that controls the motor;

a first elongate upright connected to the rotatable framework;

a second elongate upright, horizontally spaced apart from and parallel to the first elongate upright and connected to the rotatable framework;

a first movable handle and a first movable foot pedal, vertically spaced apart from each other and each being slidably engaged with the first elongate upright to enable reciprocating linear movement along the first elongate upright;

a second movable handle and a second movable foot pedal, vertically spaced apart from each other and each being slidably engaged with the second elongate upright to enable reciprocating linear movement along the second elongate upright, wherein each of the first handle, the second handle, the first foot pedal, and the second foot pedal are decoupled from each other enabling independent rotational and lateral movement;

a linkage assembly, interconnecting and synchronizing movement of the first handle, the first foot pedal, the second handle, and the second foot pedal, wherein the linkage assembly enables reciprocating concurrent movement of the first handle, the first foot pedal, the second handle, and the second foot pedal to simulate a continuous climbing motion for a user.

2. The exercise system and climbing simulator of claim 1, wherein the controller can adjust resistance in the movement of the first handle, the first foot pedal, the second handle, and the second foot pedal.

3. The exercise system and climbing simulator of claim 2, wherein the concurrent motion of the first and second movable foot pedals simulates a contralateral climbing motion.

4. The exercise system and climbing simulator of claim 3, wherein the concurrent movement of the first and second movable handles and the first and second movable foot pedals simulates an ipsilateral climbing motion.

5. The exercise system and climbing simulator of claim 4, wherein locations of the first movable handle and the first movable foot pedal relative to each other are adjustable prior to operation of the climbing exercise machine and locations of the second movable handle and the second movable foot pedal relative to each other are adjustable prior to operation of the climbing exercise machine.

6. The exercise system and climbing simulator of claim 2, wherein the base assembly further comprises a floor assembly and a column assembly, wherein the column assembly extends in a generally upward direction from the floor assembly and cooperates with the floor assembly to form a fulcrum, thereby facilitating rotational movement of the rotatable framework.

7. The exercise system and climbing simulator of claim 6, wherein the column assembly further comprises a first leg and a second leg having an angled orientation that cooperate to form a recess.

8. The exercise system and climbing simulator of claim 2, wherein the controller further comprises pre-defined programmable motions.

9. The exercise system and climbing simulator of claim 8, wherein a horizontal distance between the first and second elongate uprights is adjustable.

10. A method of using an exercise machine and climbing simulator, comprising providing a base support frame in which one end is configured to contact a floor or ground surface;

providing an axle that extends from an opposing second end of the base support frame, wherein the axle extends in a horizontal direction parallel to the ground surface;

providing a rotatable framework that is attached to the axle such that the rotatable framework completes a 360 rotation around the axle;

providing a motor that actuates rotation of the rotatable framework around the axle;

providing a controller that is used to control the motor;

providing a first elongate upright rigidly connected to the rotatable framework;

providing a second elongate upright, horizontally spaced apart from and parallel to the first elongate upright and rigidly connected to the rotatable framework;

providing a first movable handle and a first movable foot pedal, vertically spaced apart from each other and each being slidably engaged with the first elongate upright to enable reciprocating linear movement along the first elongate upright;

providing a second movable handle and a second movable foot pedal, vertically spaced apart from each other and each being slidably engaged with the second elongate upright to enable reciprocating linear movement along the second elongate upright;

providing a linkage assembly, interconnecting and synchronizing movement of the first handle, the first foot pedal, the second handle, and the second foot pedal, wherein the linkage assembly enables reciprocating concurrent movement of the first handle, the first foot pedal, the second handle, and the second foot pedal to simulate a continuous climbing motion for a user.

11. The method of using the exercise system and climbing simulator of claim 10, wherein the controller can adjust resistance in the movement of the first handle, the first foot pedal, the second handle, and the second foot pedal.

12. The method of using the exercise system and climbing simulator of claim 11, wherein the base assembly further comprises a floor assembly and a column assembly, wherein the column assembly extends in a generally upward direction from the floor assembly and cooperates with the floor assembly to form a fulcrum, thereby facilitating rotational movement of the rotatable framework.

13. The method of using the exercise system and climbing simulator of claim 12, wherein the concurrent movement of the first and second movable handles and the first and second movable foot pedals simulates an ipsilateral climbing motion.

14. The method of using the exercise system and climbing simulator of claim 12, wherein locations of the first movable handle and the first movable foot pedal relative to each other are adjustable prior to operation of the climbing exercise machine and locations of the second movable handle and the second movable foot pedal relative to each other are adjustable prior to operation of the climbing exercise machine.

15. The method of using the exercise system and climbing simulator of claim 12, wherein the column assembly further comprises a first leg and a second leg having an angled orientation that cooperate to form a recess.

16. The method of using the exercise system and climbing simulator of claim 11, wherein the controller further comprises pre-defined programmable motions.

17. The method of using the exercise system and climbing simulator of claim 16, wherein a horizontal distance between the first and second elongate uprights is adjustable.

18. The method of using the exercise system and climbing simulator of claim 11, wherein the concurrent motion of the first and second movable foot pedals simulates a contralateral climbing motion.

* * * * *